US007104831B2

(12) United States Patent
Fukatsu et al.

(10) Patent No.: US 7,104,831 B2
(45) Date of Patent: Sep. 12, 2006

(54) CONNECTOR

(75) Inventors: Yukihiro Fukatsu, Yokkaichi (JP); Yukihiro Toyoda, Yokkaichi (JP); Kiyofumi Ichida, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/174,984

(22) Filed: Jul. 5, 2005

(65) Prior Publication Data

US 2006/0003631 A1 Jan. 5, 2006

(30) Foreign Application Priority Data

Jul. 2, 2004 (JP) ..... 2004-197202

(51) Int. Cl.
*H01R 4/38* (2006.01)

(52) U.S. Cl. ..... 439/385; 439/680

(58) Field of Classification Search ..... 439/350, 439/357, 358, 385 L, 680 X, 732
See application file for complete search history.

(56) References Cited

U.S. PATENT DOCUMENTS 5,336,540 A 8/1994 Kato et al.
6,186,819 B1 * 2/2001 Holub ..... 439/358
6,332,800 B1 * 12/2001 Kodama ..... 439/357
6,579,113 B1 * 6/2003 Kodama ..... 439/358
6,843,677 B1 * 1/2005 Fukuda ..... 439/374
6,890,204 B1 * 5/2005 Yamawaki ..... 439/350

* cited by examiner

*Primary Examiner*—Thanh-Tam Le
(74) *Attorney, Agent, or Firm*—Gerald E. Hespos; Anthony J. Casella

(57) ABSTRACT

A male housing (10) includes male terminal fittings (11), and a receptacle (12) for surrounding tabs (11*a*) of the male terminal fittings (11). A female housing (20) includes female terminal fittings (21) and a tubular fitting (29) fittable on the receptacle (12). Since preventing projections (32A, 32B, 32C) for preventing relative displacements of the receptacle (12) and the tubular fitting (29) by contacting the outer surface of the receptacle (12) are provided at the back end of the inner surface of the tubular fitting (29), an abrasion between the terminal fittings (11, 21) due to fine sliding movements resulting from the relative displacements of the two housings (10, 20) can be prevented.

8 Claims, 15 Drawing Sheets

CONNECTOR

BACKGROUND OF THE INVENTION

1. Field of the Invention

The present invention relates to a connector.

2. Description of the Related Art

U.S. Pat. No. 5,336,540 discloses a connector with male and female housings. The male housing has a receptacle that surrounds tabs of male terminal fittings. The female housing has female terminal fittings that connect with the tabs by fitting the female housing into the receptacle of the male housing.

A clearance is defined between the outer surface of the female housing and the inner surface of the receptacle due to dimensional and assembling tolerances. Thus, the connected housings shake slightly, and this shaking leads to abrasion caused by fine sliding movements between the terminal fittings. As a result, there is a demand to eliminate the shaking The invention was developed in view of the above problem and an object thereof is to prevent an abrasion caused by fine sliding movements between terminal fittings.

SUMMARY OF THE INVENTION

The invention relates to a connector with first and second housings. The first housing accommodates at least one first terminal fitting and has a receptacle for surrounding parts of the first terminal fittings. The second housing accommodates at least one second terminal fitting. The first and second terminal fittings are connectable by fitting the second housing into the receptacle. The second housing includes a substantially tubular fitting that fits to the receptacle. At least one preventing projection is provided on at least one of the receptacle and the tubular fitting in a position to contact the mating side near the end of the connection of the first and second housings. For example, preventing projections may be at the leading end of the receptacle and/or the back end of the tubular fitting. The preventing projection prevents relative displacement of the receptacle and the tubular fitting, and thus prevents abrasion between the terminal fittings due to fine sliding movements.

The preventing projections preferably are provided at least at one of the leading end of the outer surface of the receptacle and the back end of the inner surface of the tubular fitting.

The first housing preferably is a male housing that accommodates male terminal fittings and the receptacle surrounds tabs of the male terminal fittings. The second housing preferably is a female housing that accommodates female terminal fittings. The female terminal fittings connect to the tabs by fitting the female housing into the receptacle. The female housing includes the tubular fitting, and the receptacle is fittable to the tubular fitting. The preventing projections are the leading end of the outer surface of the receptacle and/or the back end of the inner surface of the tubular fitting.

The preventing projections preferably are provided only on the tubular fitting.

The preventing projections preferably are disposed to avoid creating significant connection resistance until a stage immediately before the proper connection of the two housings. Thus, connection efficiency is good.

A lock arm preferably is provided at a surface of the tubular fitting and engages a lock on the outer surface of the receptacle.

At least one guiding rib preferably is provided on an outer surface of the receptacle and extends substantially along a connecting direction of the housings. At least one guiding groove preferably is provided on an inner surface of the tubular fitting and extends substantially in the connecting direction of the housings for engaging the corresponding guiding rib.

At least one of the preventing projections may be on a leading end of a guiding rib or a surface at the back end of a guiding groove.

A preventing projection may be on a leading outer surface of the receptacle or the back end of an inner surface of the tubular fitting.

The presence of the lock arm and the lock on the upper walls of tubular fitting and the receptacle may complicate the disposition of the preventing projections on the upper walls. However, a vertical displacement of the housings is prevented by the left and right preventing projections on the guiding ribs or the guiding grooves and the preventing projections on the bottom walls of the receptacle or the tubular fitting.

At least one preventing projection preferably is at the back end of the tubular fitting, and at least one notch for weakening a portion of the tubular fitting is at the opposite sides of the corresponding preventing projection.

At least one notch may be provided on a part of the tubular fitting that has the preventing projection. The notch makes adjacent parts of the tubular fitting resiliently displaceable. The preventing projection contacts the receptacle in the process of connecting the housings, and is displaced away from the receptacle. Thus, the connection resistance resulting from the interference of the preventing projection and the receptacle is reduced.

An area of the outer surface of the tubular fitting between a pair of notches is recessed to form a thinned portion. Thus, the area of the tubular fitting where the preventing projection is formed is thinned to displace more easily, and the female housing is made lighter.

At least one guiding surface preferably is formed at the front of the preventing projections and is inclined with respect to a connecting direction of the housings.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
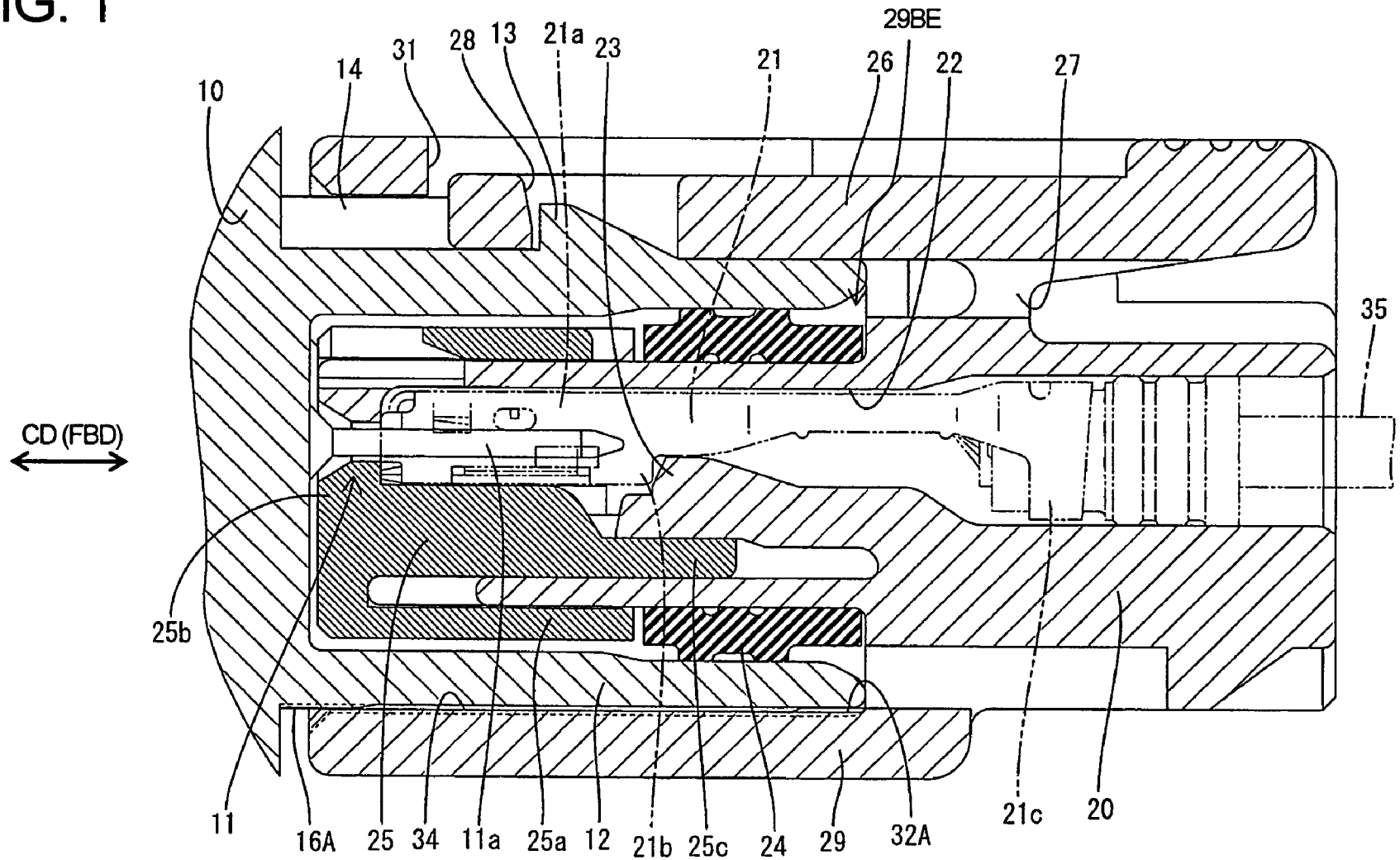
FIG. 1 is a longitudinal section showing a state where a male and a female housings are connected in a first embodiment.
Figure 2:
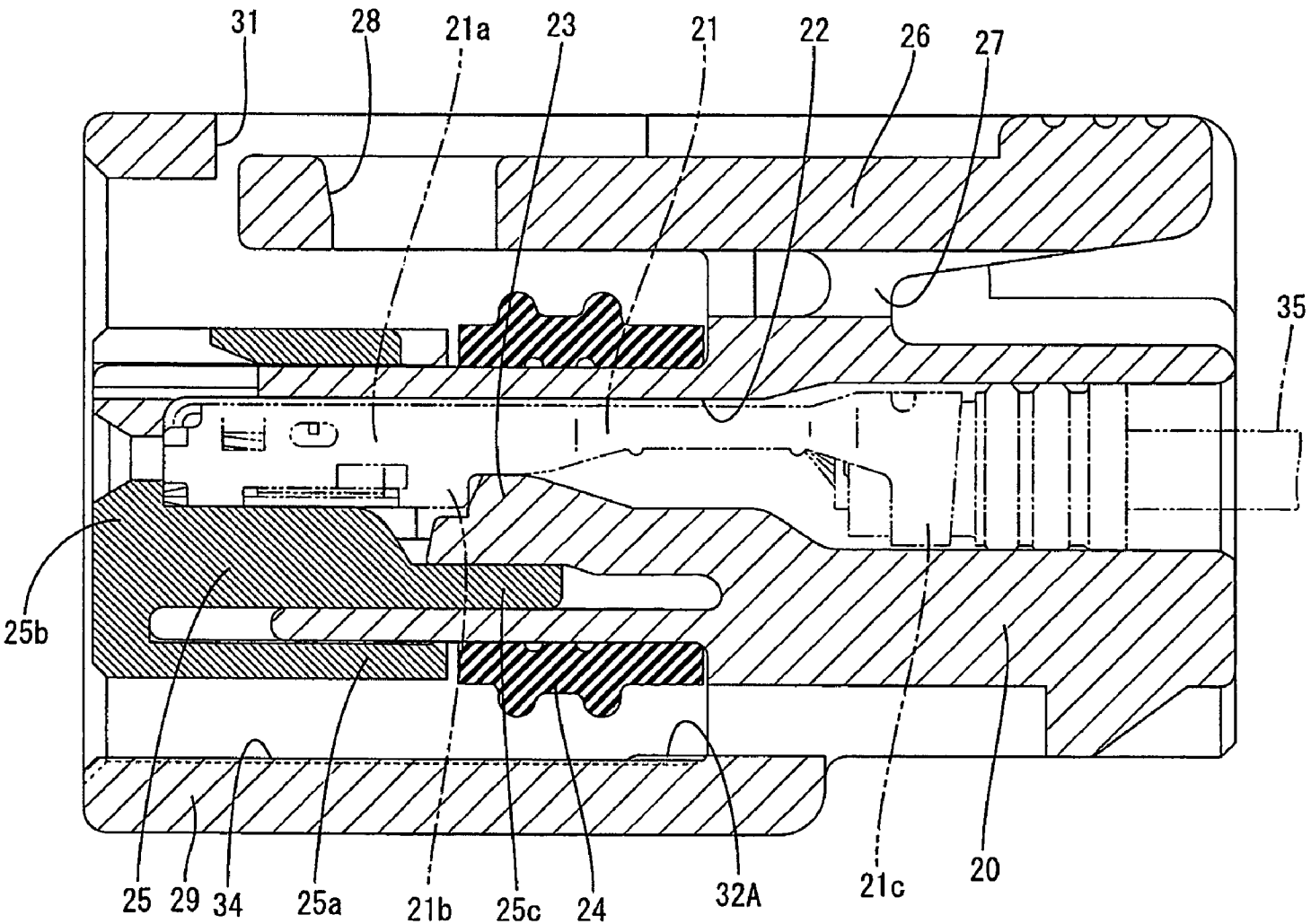
FIG. 2 is a section of the female housing.
Figure 3:
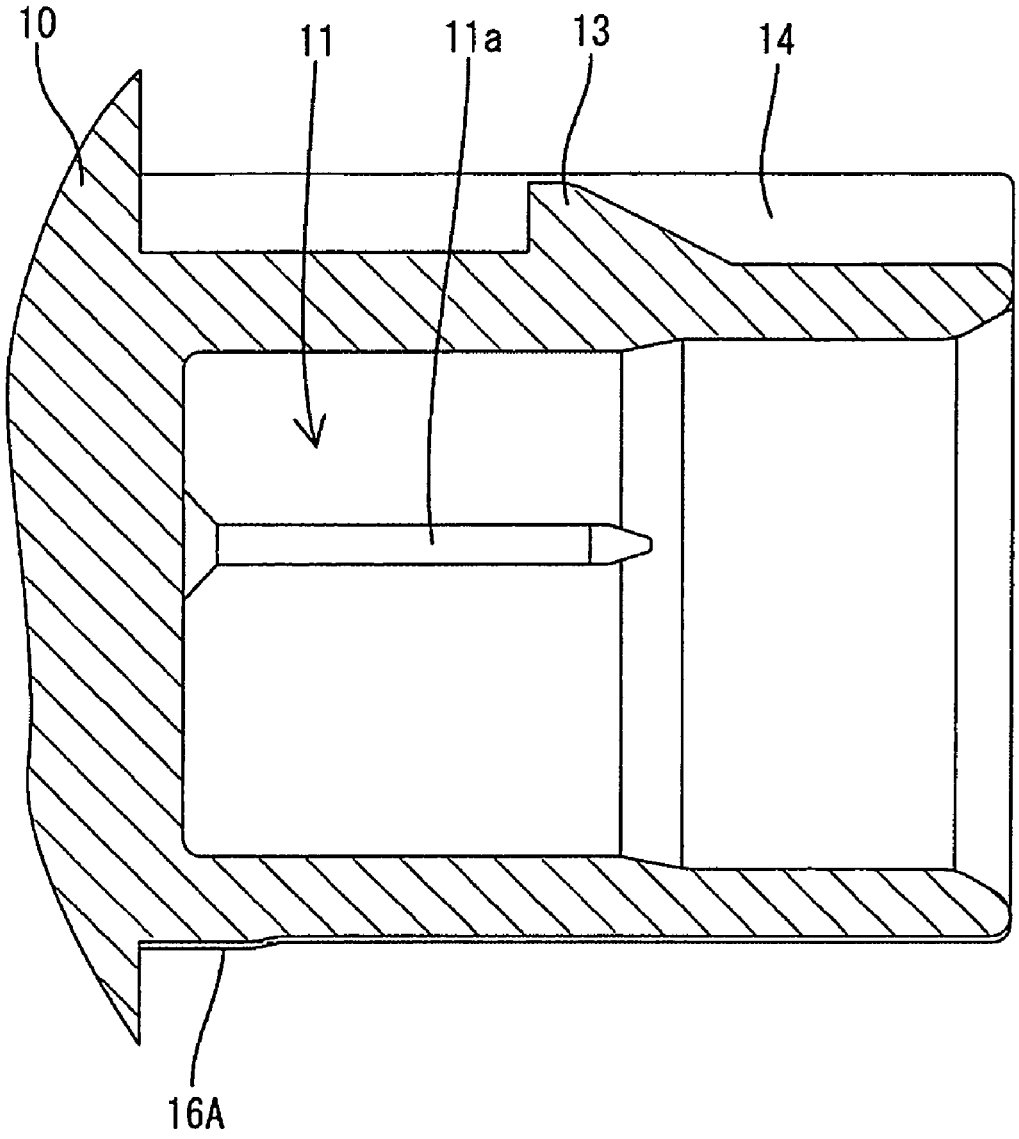
FIG. 3 is a section of the male housing.
Figure 4:
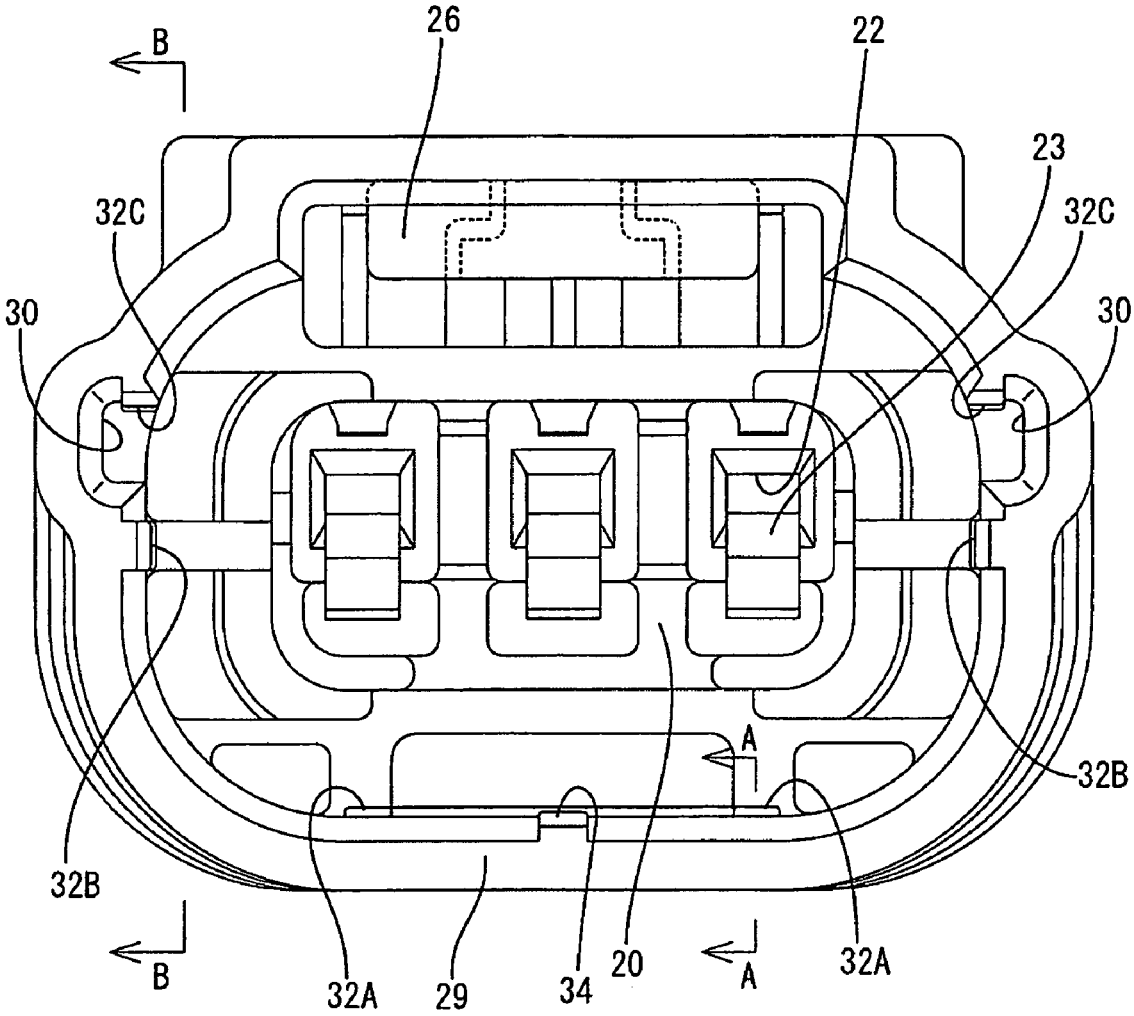
FIG. 4 is a front view of the female housing.
Figure 5:
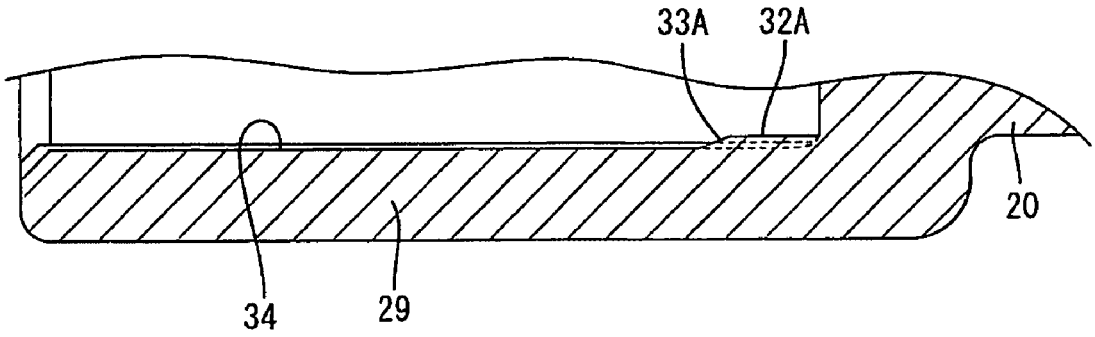
FIG. 5 is a section along 5—5 of FIG. 4.
Figure 6:
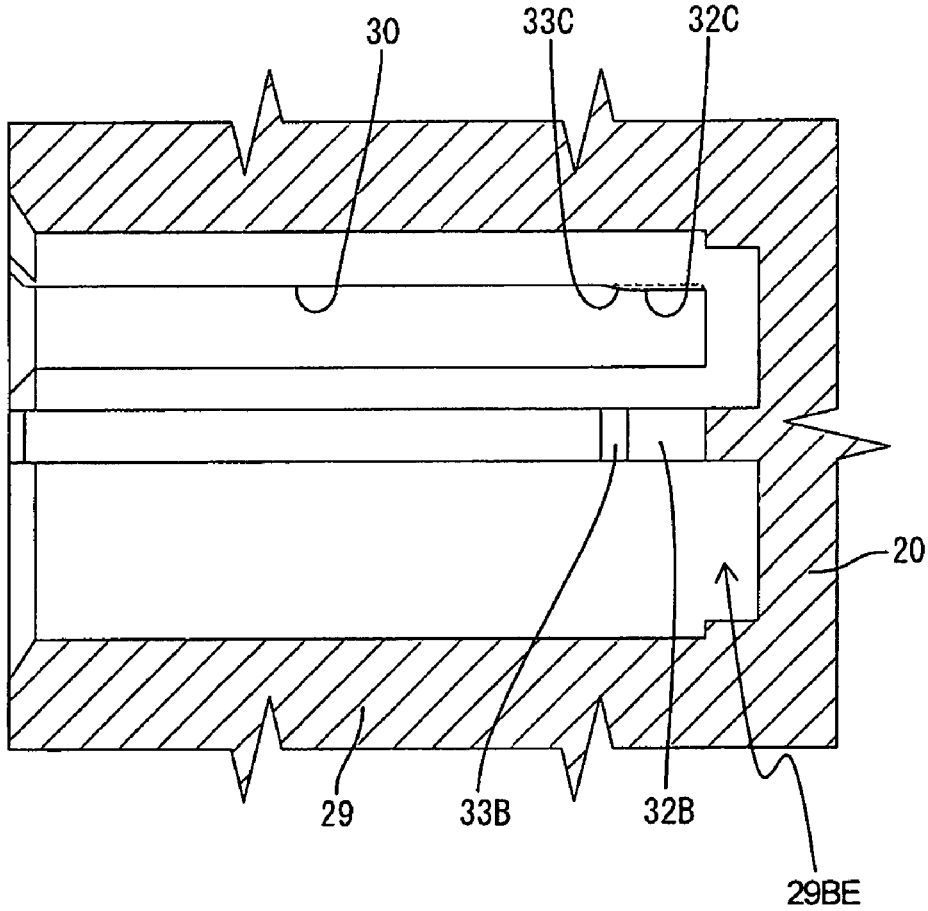
FIG. 6 is a section along 6—6 of FIG. 4.
Figure 7:
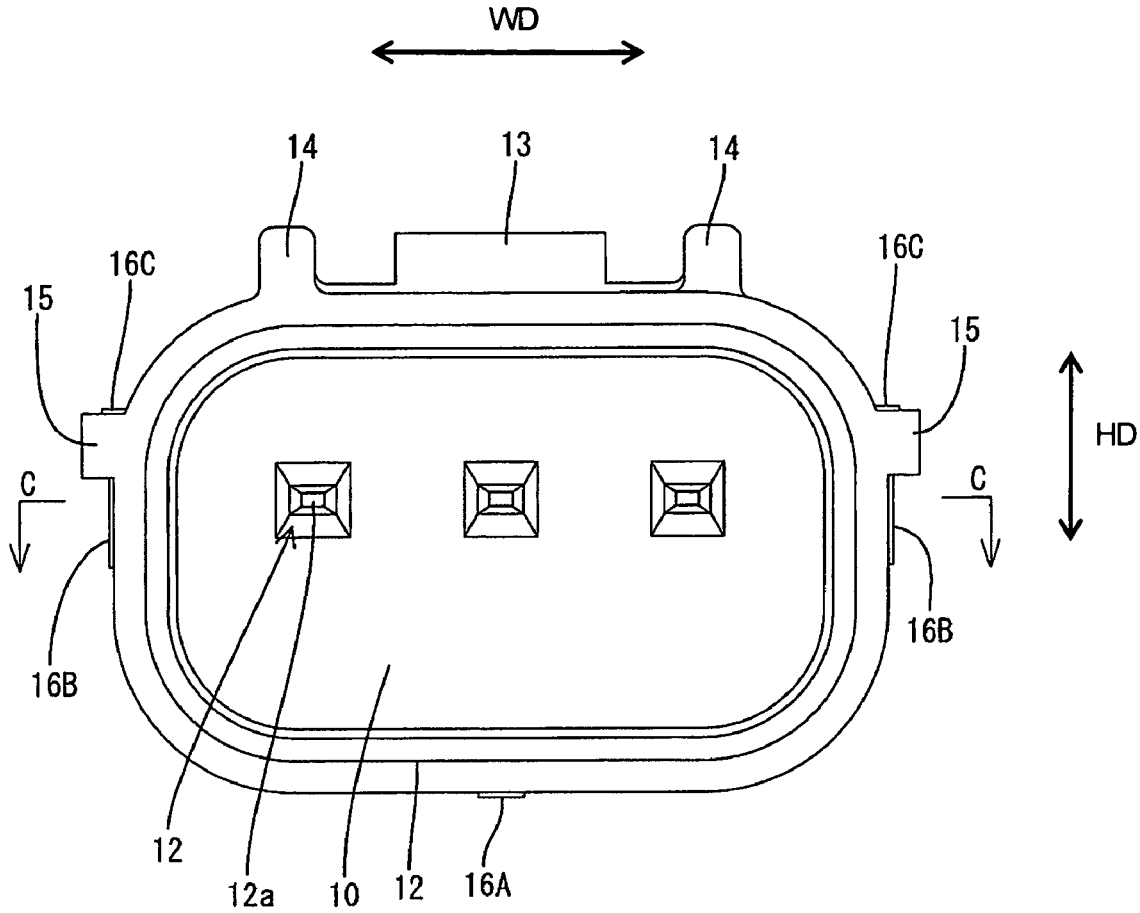
FIG. 7 is a front view of the male housing.
Figure 8:
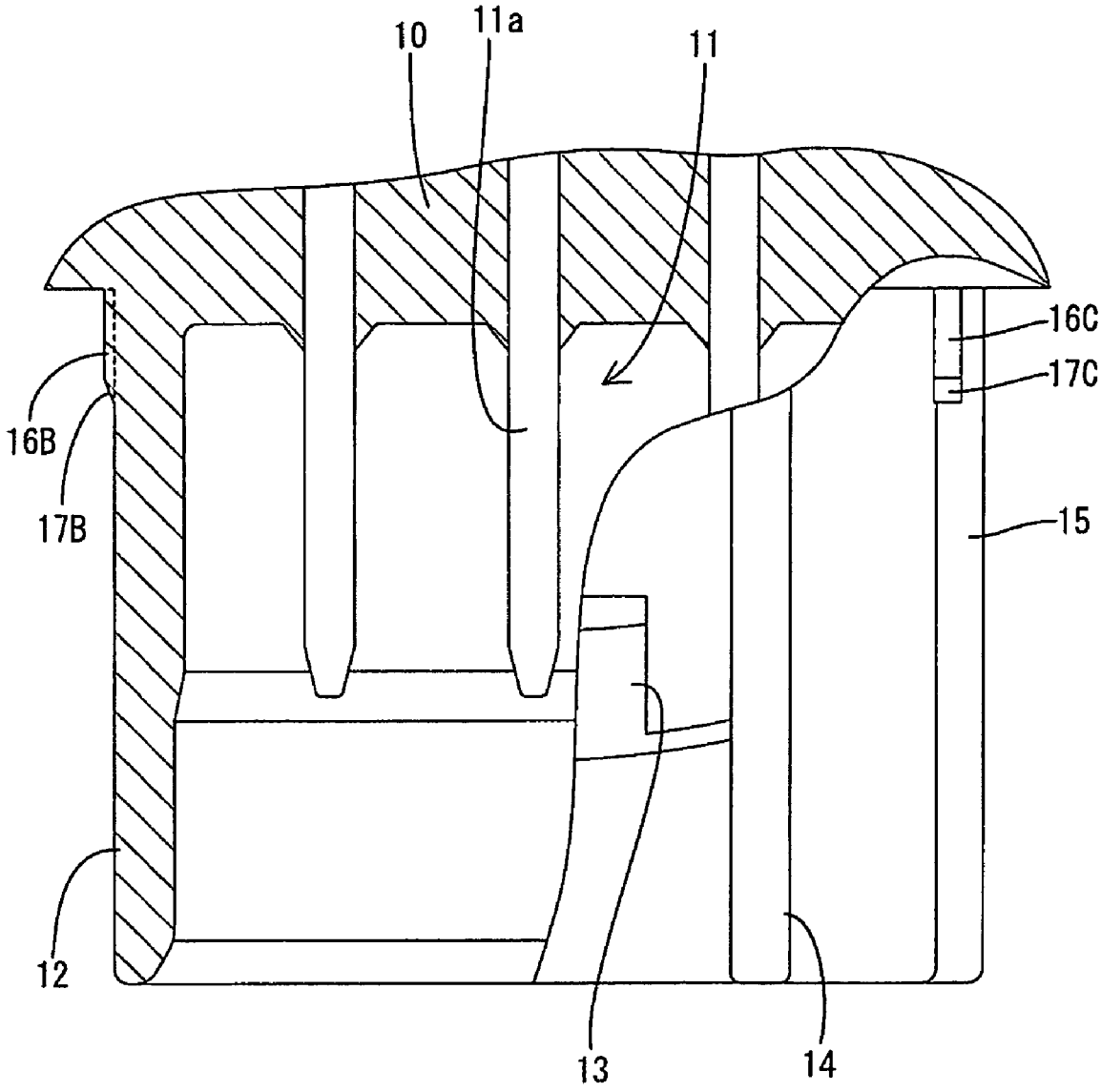
FIG. 8 is a section along 8—8 of FIG. 7.
Figure 9:
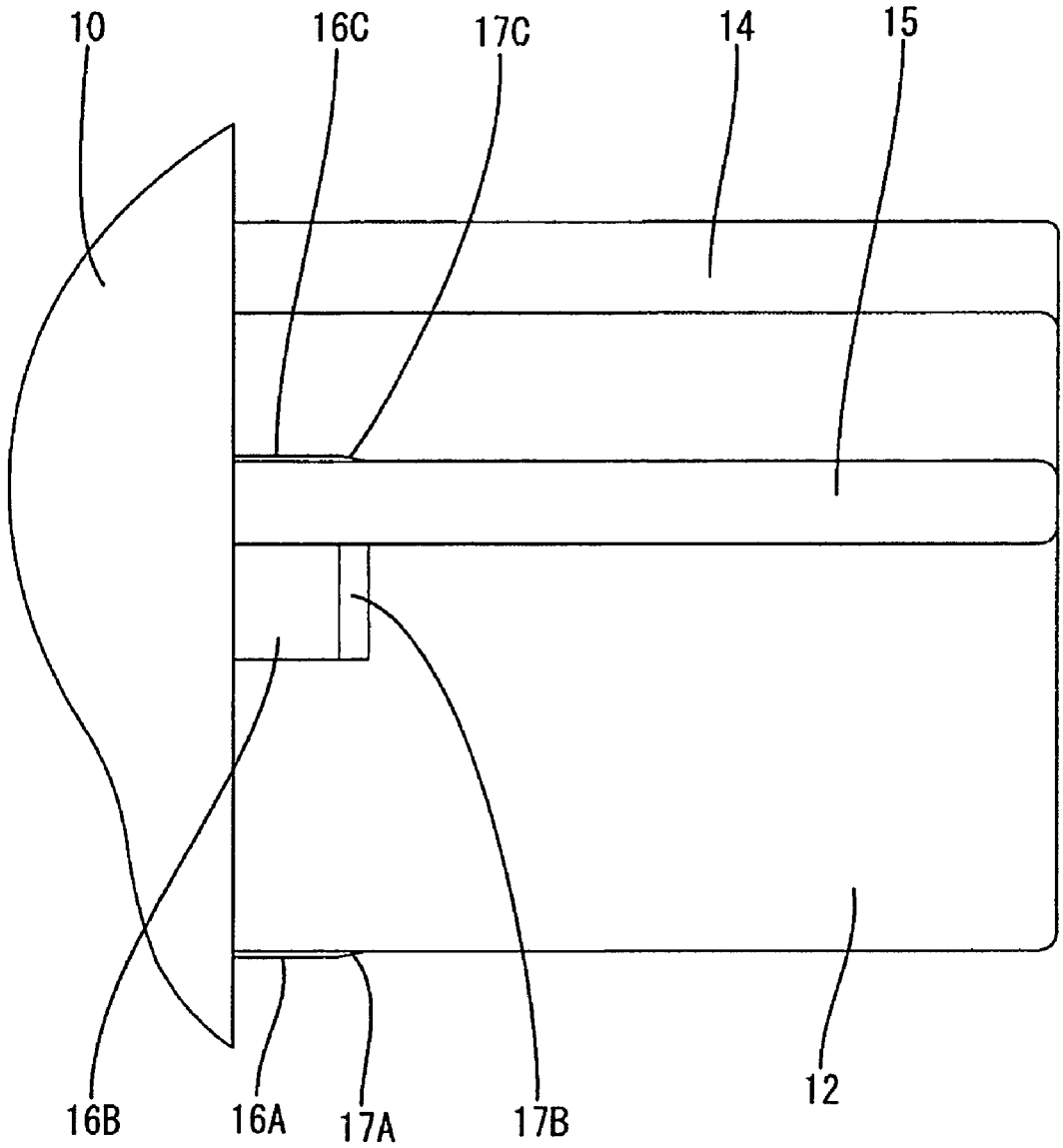
FIG. 9 is a side view of the male housing.
Figure 10:
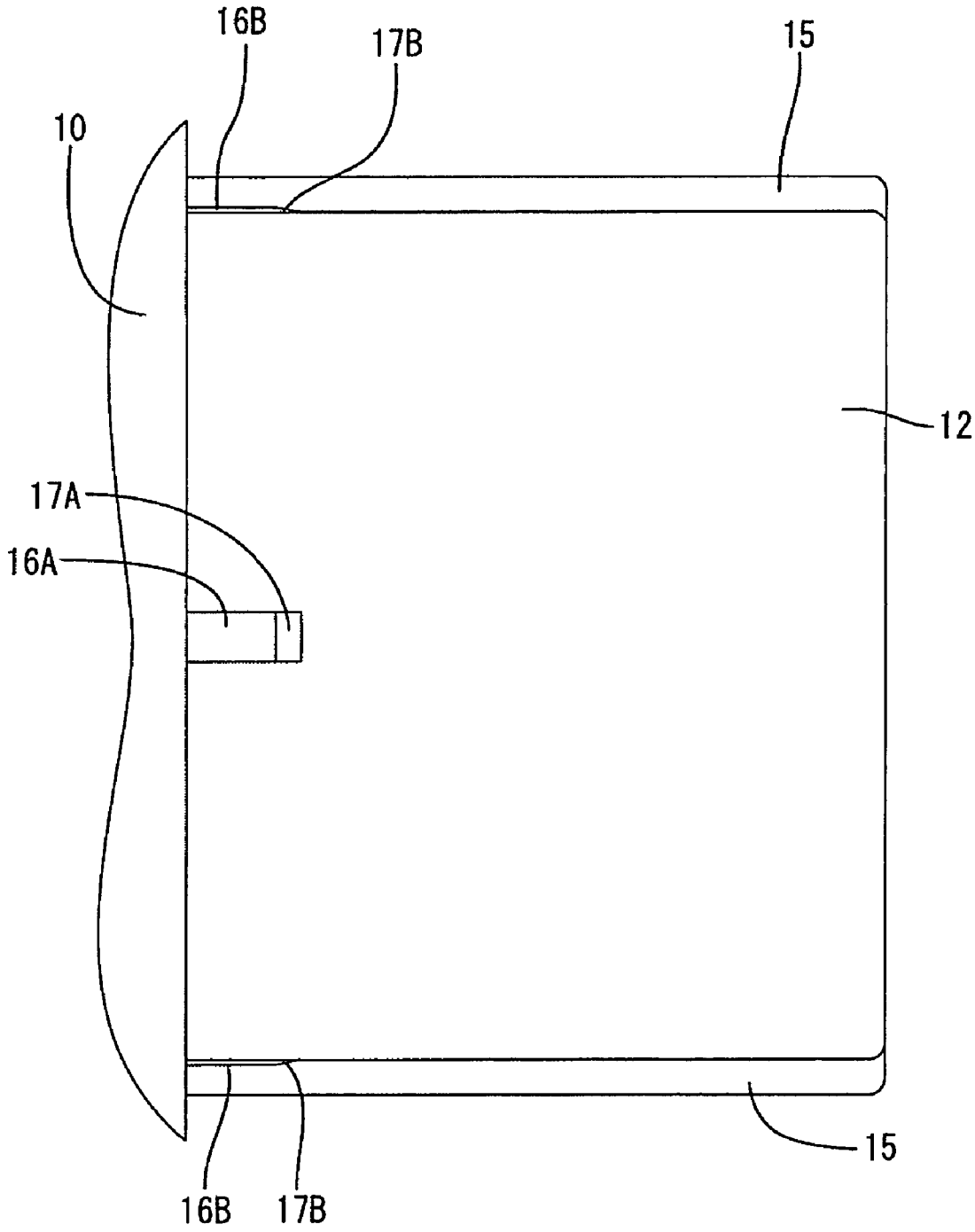
FIG. 10 is a bottom view of the male housing.
Figure 11:
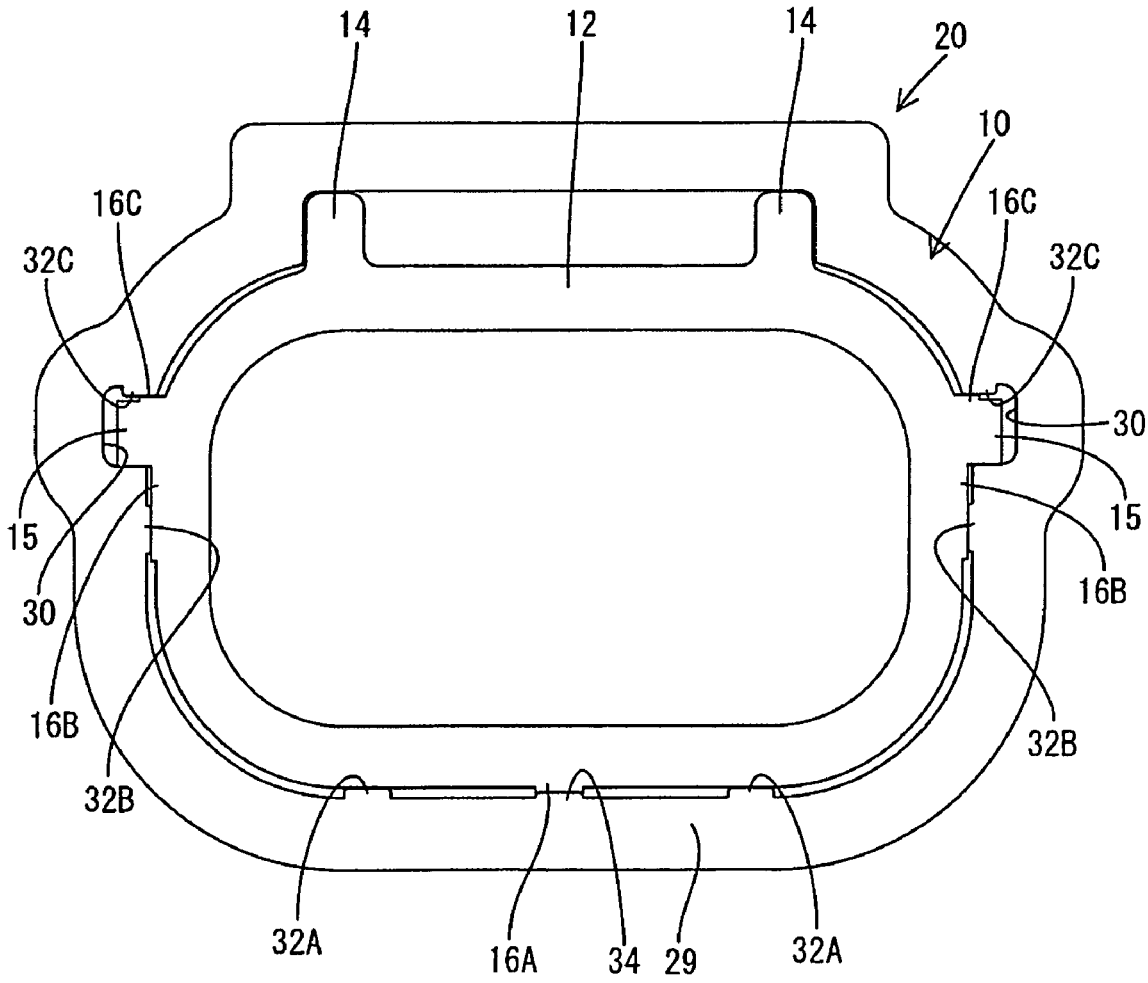
FIG. 11 is a schematic diagram showing a state where a receptacle is fit in a tubular fitting.
Figure 12:
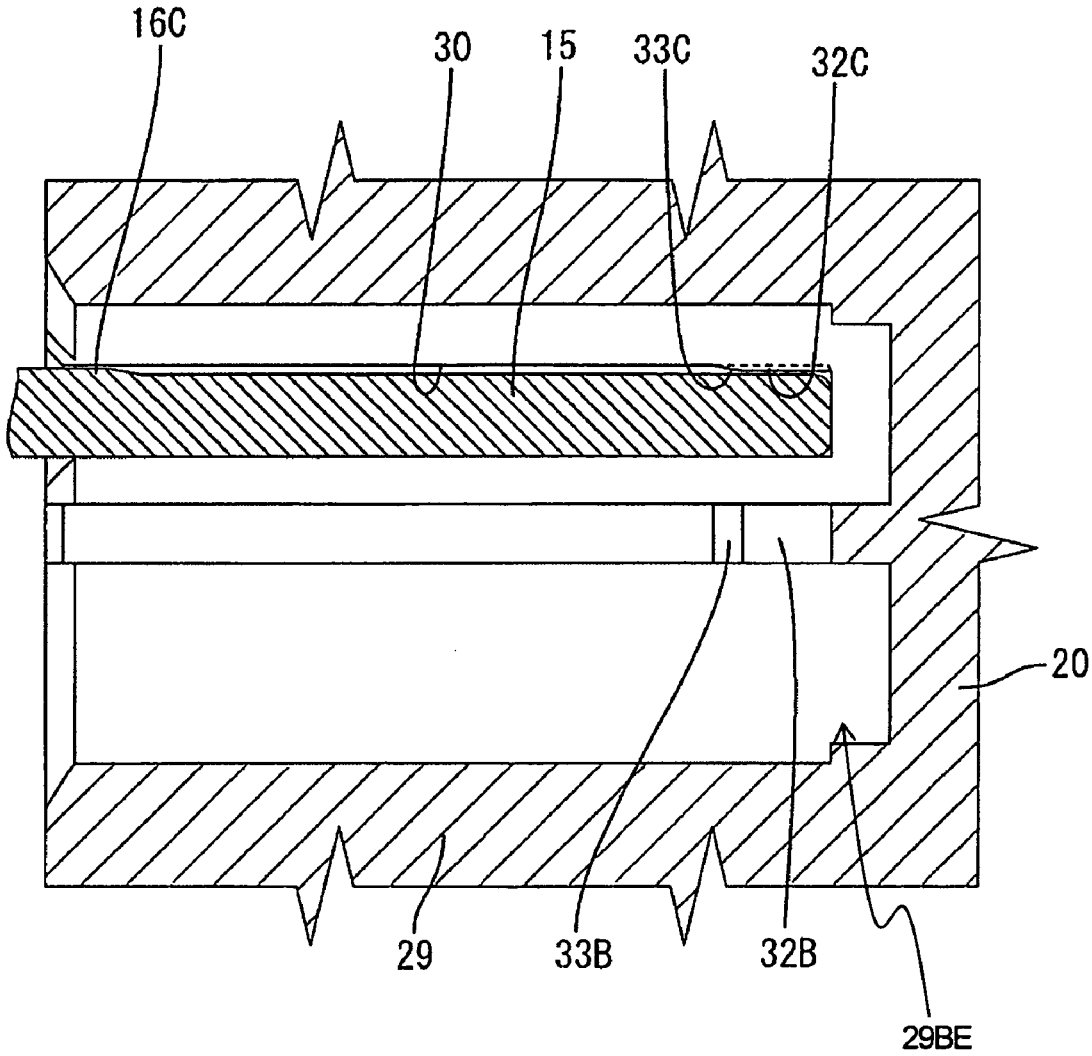
FIG. 12 is a section of a guiding rib engaged with a guiding groove.

A connector according to a first embodiment of the invention is described with reference to FIGS. 1 to 12. The connector of this embodiment has a male housing 10 accommodating male terminal fittings 11 and a female housing 20 accommodating female terminal fittings 21. Connecting sides of each housing 10, 20 are referred to herein as the front.

The male housing 10 is made e.g. of a synthetic resin and has a receptacle 12 that projects forward in substantially the same direction as a connecting direction CD with the female housing 20. Long narrow tabs 11*a* project forward on the male terminal fittings 11 into the receptacle 12. Thus, the receptacle 12 protects the tabs 11*a* from interference by external matter. A lock 13 projects up on the outer surface of the upper wall of the receptacle 12 at a substantially middle position with respect to the width direction WD and forward and backward directions FBD of the receptacle 12. Rib-shaped projections 14 are formed on the outer surface of the upper wall of the receptacle 12 at opposite lateral sides of the lock 13 and extend in forward and backward directions FBD over substantially the entire length of the receptacle 12. Guiding ribs 15 are formed at substantially transversely symmetrical positions on the outer surfaces of the lateral walls of the receptacle 12 and extend in forward and backward directions FBD over substantially the entire length of the receptacle 12 from the front end to the rear end. The guiding ribs 15 have substantially rectangular cross sections.

Auxiliary projections 16A, 16B, 16C are formed on the outer circumferential surfaces of the receptacle 12 for preventing shaking between the housings 10, 20 in directions intersecting with the connecting direction CD of the two housings 10, 20. The auxiliary projections 16A, 16B, 16C are arranged towards the rear end of the receptacle 12.

One auxiliary projection 16A is formed at a substantially widthwise middle of a substantially flat area of the bottom wall of the receptacle 12. The auxiliary projection 16A is long and narrow in forward and backward directions FBD. Auxiliary projections 16B are formed on opposite left and right walls of the receptacle at substantially transversely symmetrical positions below the guiding ribs 15. The auxiliary projections 16B are substantially rectangular in side view and are in intermediate positions with respect to the height direction HD of the receptacle 12. The auxiliary projections 16C are substantially transversely symmetrical on the substantially horizontal and flat upper surfaces of the left and right guiding ribs 15. The auxiliary projections 16C are long and narrow in forward and backward directions FBD and are substantially parallel with both the bottom wall of the receptacle 12 and the connecting direction CD. Thus, the auxiliary projections 16C project substantially in the height direction HD from the upper surfaces of the guiding ribs 15. A projecting distance of the auxiliary projections 16A, 16B, 16C from the outer surfaces of the receptacle 12 is slightly larger than a clearance between the receptacle 12 and the tubular fitting 29 in view of dimensional tolerance and/or assembling tolerance. Further, the projecting end surfaces of the respective auxiliary projections 16A, 16B, 16C all are substantially flat. Long narrow guiding surfaces 17A, 17B, 17C are formed at the front ends of the respective auxiliary projections 16A, 16B, 16C and are inclined to the forward and backward directions FBD.

The female housing 20 is in the form of a block made e.g. of a synthetic resin. A front portion of the female housing 20 is insertable into the receptacle 12. Long narrow cavities 22 extend in forward and backward directions FBD in the female housing 20 and are configured to receive the female terminal fittings 21 from behind. A resiliently deformable lock 23 is cantilevered forward from the bottom wall of each cavity 22. A resilient seal ring 24 is mounted in an area of the outer surface of the female housing 20 corresponding to the locks 23. A retainer 25 is mounted to the female housing 20 from the front. The retainer 25 is made e.g. of a synthetic resin and includes a stopper 25*a* for preventing the seal ring 24 from coming off forward. The retainer 25 has a cavity forming wall 25*b* that forms front portions of the inner walls of the cavities 22, and a displacement preventing wall 25*c* for preventing displacements of the locks 23 away from the female terminal fittings 21.

The female housing 20 is formed with at least one lock arm 26 extending substantially in forward and backward directions FBD. The lock arm 26 is supported on the upper surface of the female housing 20 via a leg 27 substantially in the longitudinal middle of the lock arm 26. The lock arm 26 is resiliently deformable to incline forward and backward with the leg 27 as a pivot point. A locking hole 28 is formed near the front of the lock arm 26 and is engageable with the lock 13 of the receptacle 12 when the two housings 10, 20 are connected properly.

The female housing 20 is formed unitarily with a tubular fitting 29 at least partly surrounding substantially the front half of the female housing 20. The tubular fitting 29 has the rear end thereof coupled to the outer surface of the female housing 20 and is open forward along the connecting direction CD with the male housing 10. The receptacle 12 fits into a clearance between the inner peripheral surface of the tubular fitting 29 and the outer peripheral surface of the female housing 20 when the housings 10, 20 are connected properly with each other. In other words, the tubular fitting 29 surrounds the receptacle 12. Left and right guiding grooves 30 are formed in the inner surfaces of the left and right walls of the tubular fitting 29 for receiving the guiding ribs 15 of the receptacle 12. A notch 31 is formed in an area of the upper wall of the tubular fitting 29 substantially corresponding to the formation area of the lock arm 26 to avoid interference with the lock arm 26.

Each female terminal fitting 21 has opposite front and rear ends. A rectangular tubular connecting portion 21*a* is formed at the front end for receiving the tab 11*a* from the front. An engaging portion 21*b* is formed at the rear end of the connecting portion 21*a* and is engageable with the lock 23 when the female terminal fitting 21 is inserted to a proper position in the cavity 22 for retaining the female terminal fitting 21 in the cavity 22. A wire connection portion 21*c* is formed at the rear end portion of the female terminal fitting 21 for crimped, bent or folded connection with a wire 35. A resilient contact piece (not shown) is provided in the connecting portion 21*a* and resiliently engages the tab 11*a* when the female terminal fitting 21 is inserted properly. These touching portions are located before the seal ring 24 and the locks 23.

Preventing projections 32A, 32B, 32C are formed on the inner surface of the tubular fitting 29 for preventing the connected housings 10, 20 from shaking in directions intersecting the connecting direction CD. The preventing projections 32A, 32B, 32C all are near the back end 29BE of the tubular fitting 29.

Two long narrow transversely symmetrical preventing projections 32A project up from a substantially flat area of the bottom wall of the tubular fitting 29 and extend along the forward and backward directions FBD. Two long narrow transversely symmetrical preventing projections 32B project in from the left and right walls of the tubular fitting 29 and extend along the forward and backward directions FBD. Two long narrow transversely symmetrical preventing projections 32C project down from the upper surfaces of the left and right guiding grooves 30 and extend along the forward and backward directions FBD. A projecting distance of these preventing projections 32A, 32B, 32C from the inner surfaces of the tubular fitting 29 is slightly larger than the clearance between the receptacle 12 and the tubular fitting 29 in view of the dimensional tolerance and/or the assembling tolerance. Further, the projecting end surfaces of the respective preventing projections 32A, 32B, 32C are substantially flat. Guiding surfaces 33A, 33B, 33C are formed at the front ends of the respective preventing projections 32A, 32B, 32C are inclined with respect to the connecting direction CD of the two housings 10, 20.

The preventing projections 32B on the left and right walls of the tubular fitting 29 correspond to the auxiliary projections 16B on the corresponding left and right walls of the receptacle 12 with respect to the width direction WD. The preventing projections 32C on the upper surfaces of the left and right guiding grooves 30 correspond to the auxiliary projections 16C of the guiding ribs 15 of the receptacle 12 with respect to the vertical direction VD. The preventing projections 32A on the bottom wall of the tubular fitting 29 correspond to the bottom wall of the receptacle 12 with respect to the vertical direction VD. A long narrow loose movement preventing portion 34 is located substantially in the widthwise middle of the bottom wall of the tubular fitting 29 and extends along the forward and backward directions FBD over the substantially entire length of the tubular fitting from the front end to the back end 29BE of the tubular fitting 29. The loose movement preventing portion 34 corresponds to the auxiliary projection 16A of the bottom wall of the receptacle 12 with respect to the vertical direction VD.

The receptacle 12 is fit into the clearance between the female housing 20 and the tubular fitting 29 in the process of connecting the two housings 10, 20. However, the preventing projections 32A, 32B, 32C at the rear end 29BE of the tubular fitting 29 and the receptacle 12 do not touch each other up to a stage immediately before the two housings 10, 20 are connected properly. Thus, sufficient clearance is ensured between the outer peripheral surface of the receptacle 12 and the inner peripheral surface of the tubular fitting 29. Accordingly, the receptacle 12 and the tubular fitting 29 are relatively displaceable in directions intersecting the connecting direction CD. The preventing projections 32A, 32B, 32C and the auxiliary projections 16A, 16B, 16C create virtually no connection resistance during these early stages of connection of the housings 10, 20.

The two housings 10, 20 may shake due to the clearance between the receptacle 12 and the tubular fitting 29 as described above. However, the loose movement preventing portion 34 is formed on the inner peripheral surface of the tubular fitting 29 and projects towards the receptacle 12 to substantially reduce the clearance. Thus, shaking between the two housings 10, 20 is suppressed without creating substantial connection resistance.

The front end of the receptacle 12 contacts the seal ring 24 immediately before the housings 10, 20 are connected properly. As a result, the seal ring 24 deforms resiliently in radial and/or longitudinal directions, and the resilient restoring force of the seal ring 24 creates a connection resistance. The front end of the receptacle 12 contacts the guiding surfaces 33A, 33B, 33C of the respective preventing projections 32A, 32B, 32C as the two housings 10, 20 are connected further and, substantially simultaneously, the guiding surfaces 17A, 17B, 17C of the auxiliary projections 16A, 16B, 16C contact the tubular fitting 29. A slight connection resistance is created by this contact. The outer peripheral surface of the receptacle 12 slides in contact with the outer surfaces of the preventing projections 32A, 32B, 32C and the inner peripheral surface of the tubular fitting 29 slides in contact with the outer surfaces of the auxiliary projections 16A, 16B, 16C as the connection of the two housings 10, 20 proceeds. A slight connection resistance is created by this sliding contact. Relative displacements (shaking) of the housings 10, 20 in directions intersecting the connecting direction CD are prevented while the connection resistance resulting from this sliding movement is created.

Contact of the preventing projections 32A, 32B, 32C with the receptacle 12 and contact of the auxiliary projections 16A, 16B, 16C with the tubular fitting 29 prevents shaking or other relative displacements between the housings 10, 20 in directions intersecting the connecting direction CD even when the two housings 10, 20 are connected properly. The contact positions of the preventing projections 32A, 32B, 32C with the receptacle 12 along the connection stroke of the housings 10, 20 are slightly more back towards the back end 29BE of the tubular fitting 29 from the contact position of the receptacle 12 with the seal ring 24. These contact positions of the preventing projections 32A, 32B, 32C with the receptacle 12 also are more backward toward the back end 29BE of the tubular fitting 29 than the contact portions of the female terminal fittings 21 with the tabs 11*a*, and more backward than the engaged portions of the locks 23 and the female terminal fittings 21. These contact positions are displaced forward of the tabs 11*a* from the position where the front end 26F of the lock arm 26 presses the upper wall of the receptacle 12 in at a position behind the lock 13.

The tabs 11*a* of the male terminal fittings 11 enter the female terminal fittings 21 and contact the resilient contact pieces (not shown) in the connecting portions 21*a* when the housings 10, 20 are connected properly so that the mating terminals 11, 21 are connected. Further, the seal ring 24 hermetically seals the clearance between the inner peripheral surface of the front end of the receptacle 12 and the outer peripheral surface of the female housing 20.

As described above, the preventing projections 32A, 32B, 32C are provided at the back end 29BE of the inner surface of the tubular fitting 29 and contact the outer surface of the receptacle 12 for preventing relative displacements of the receptacle 12 and the tubular fitting 29. Thus, an abrasion between the terminal fittings 11, 21 due to fine sliding movements resulting from the relative displacements of the two housings 10, 20 is prevented.

Further, the preventing projections 32A, 32B, 32C are provided only on the tubular fitting 29. Thus, no connection resistance results from the interference of the preventing projections 32*a*, 32B, 32C with the receptacle 12 up to the stage immediately before the proper connection of the two housings 10, 20. Thus, connection is easier.

It is spatially difficult to provide preventing portions on the respective upper wall of the tubular fitting 29 and/or the receptacle 12 because the lock arm 26 is on the upper surface of the tubular fitting 29 and the lock 13 that engages the lock arm 26 is on the corresponding upper outer surface of the receptacle 12. However, the guiding ribs 15 extend along the connecting direction CD of the two housings 10, 20 on the left and right outer surfaces of the receptacle 12. Additionally, the guiding grooves 30 extend along the connecting direction CD of the housings 10, 20 on the inner surface of the tubular fitting 29 and engage the respective guiding ribs 15. Furthermore, the preventing projections 32C are provided on the upper surfaces of the back ends of the guiding grooves 30; and the preventing projections 32A are provided at the back end 29BE of the inner bottom surface of the tubular fitting 29. Thus, the left and right downward-projecting preventing projections 32C on the guiding grooves 30 and the upward-projecting preventing projections 32A on the corresponding bottom wall of the tubular fitting 29 prevent relative vertical displacements of the two housings 10, 20.

Further, relative transverse displacements of the housings 10, 20 are prevented by the inward-projecting preventing projections 32B on the left and right walls of the tubular fitting 29.

Figure 13:
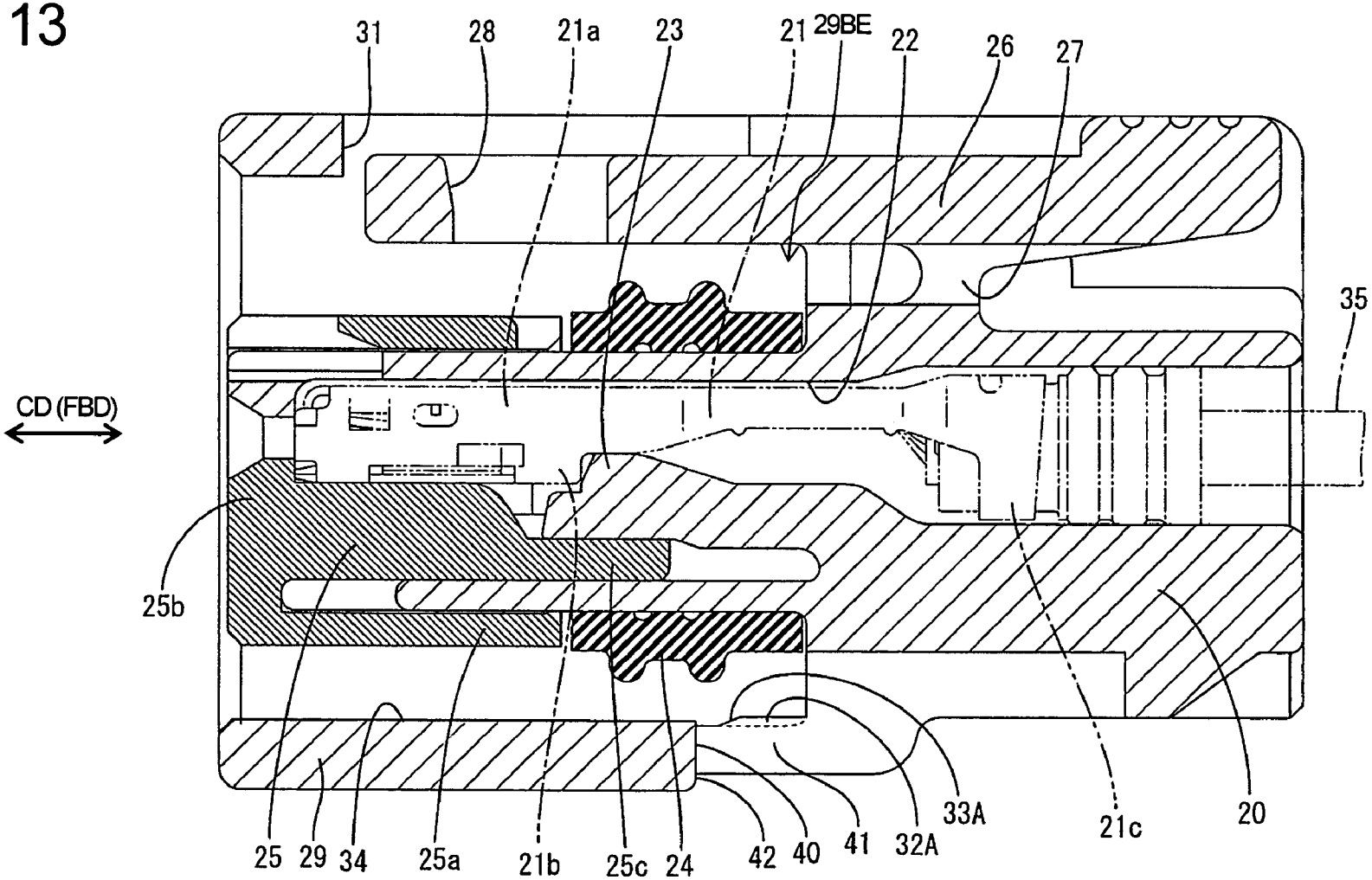
FIG. 13 is a section of a female housing of a second embodiment.
Figure 14:
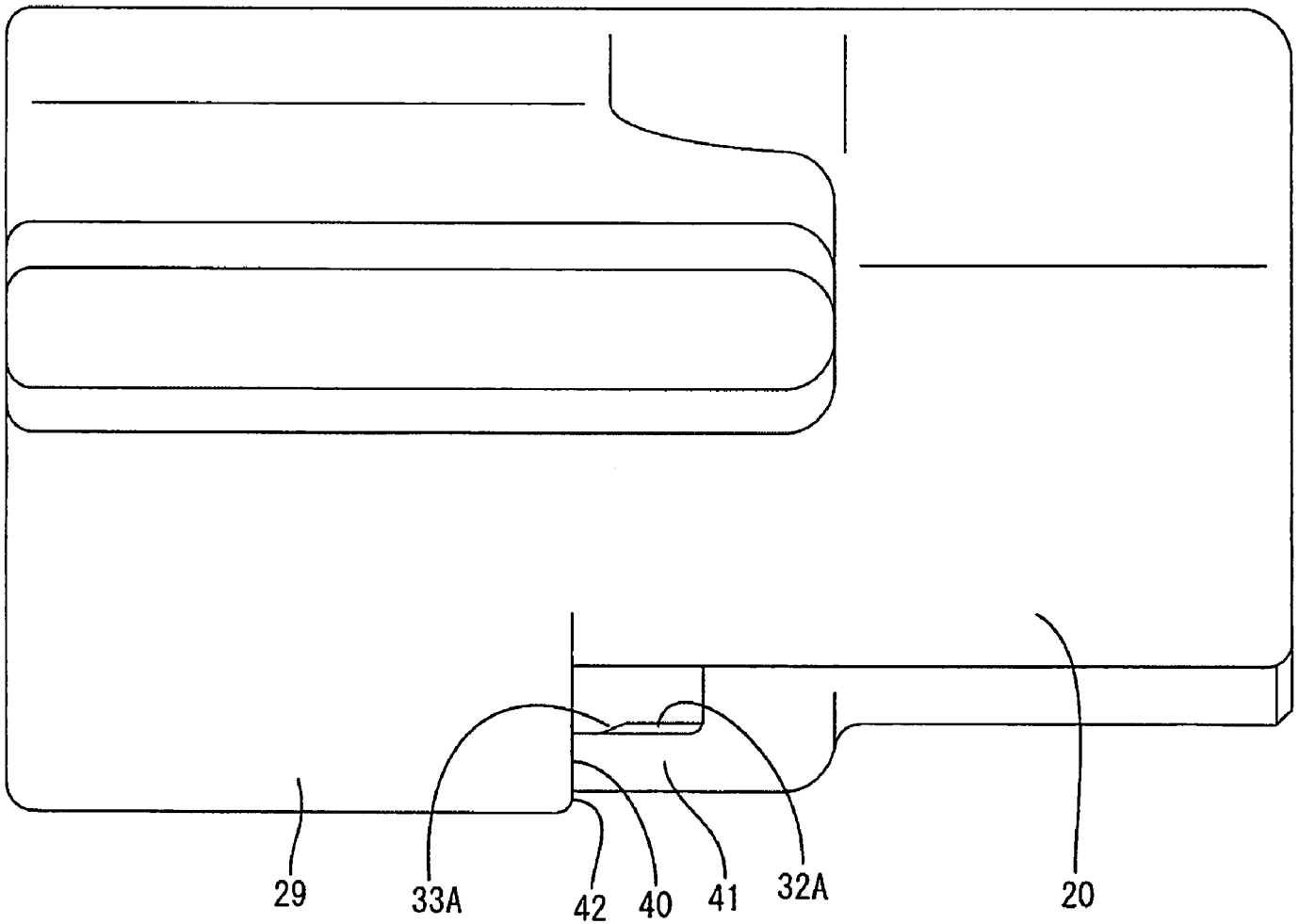
FIG. 14 is a side view of the female housing.
Figure 15:
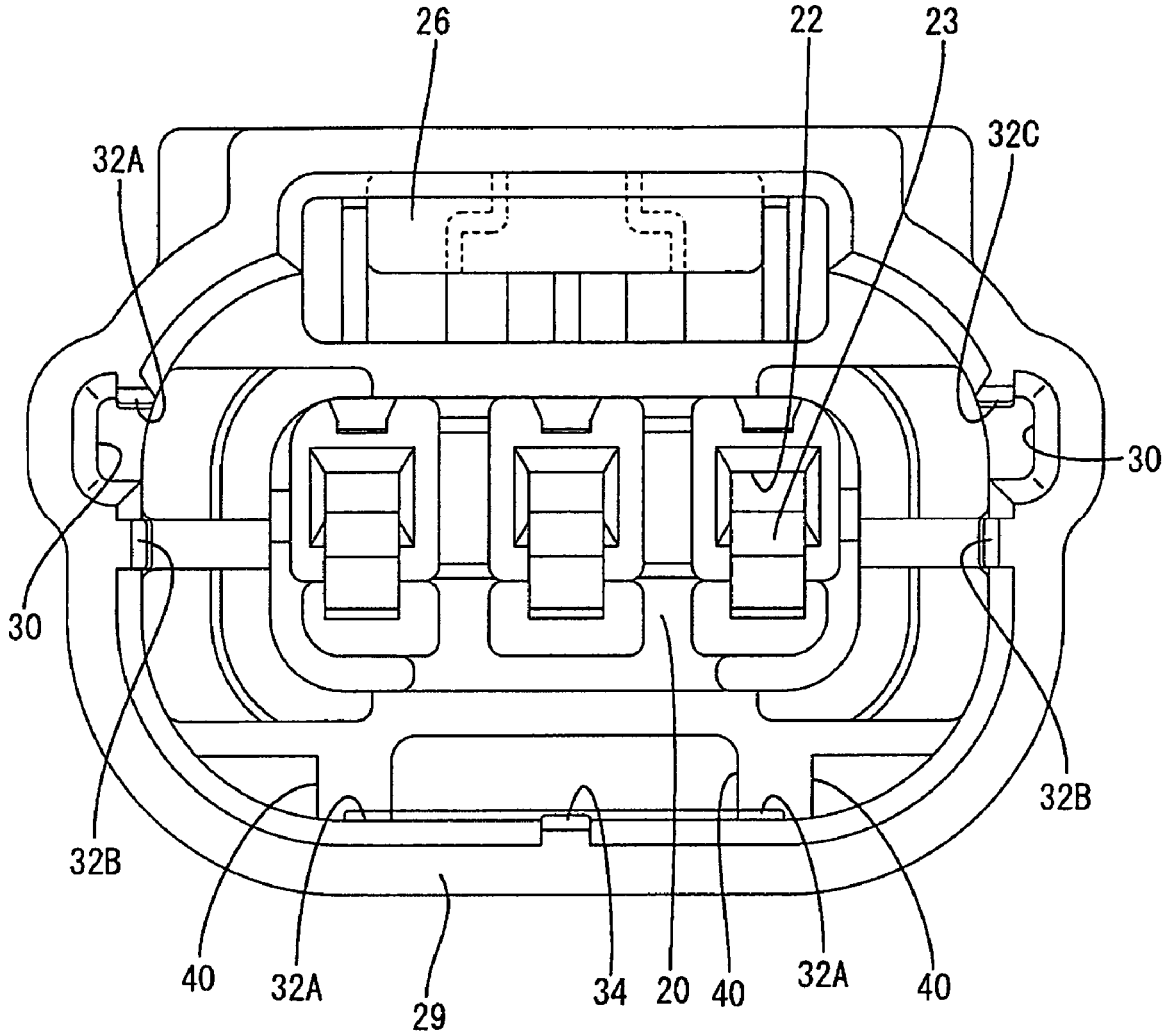
FIG. 15 is a front view of the female housing.
Figure 16:
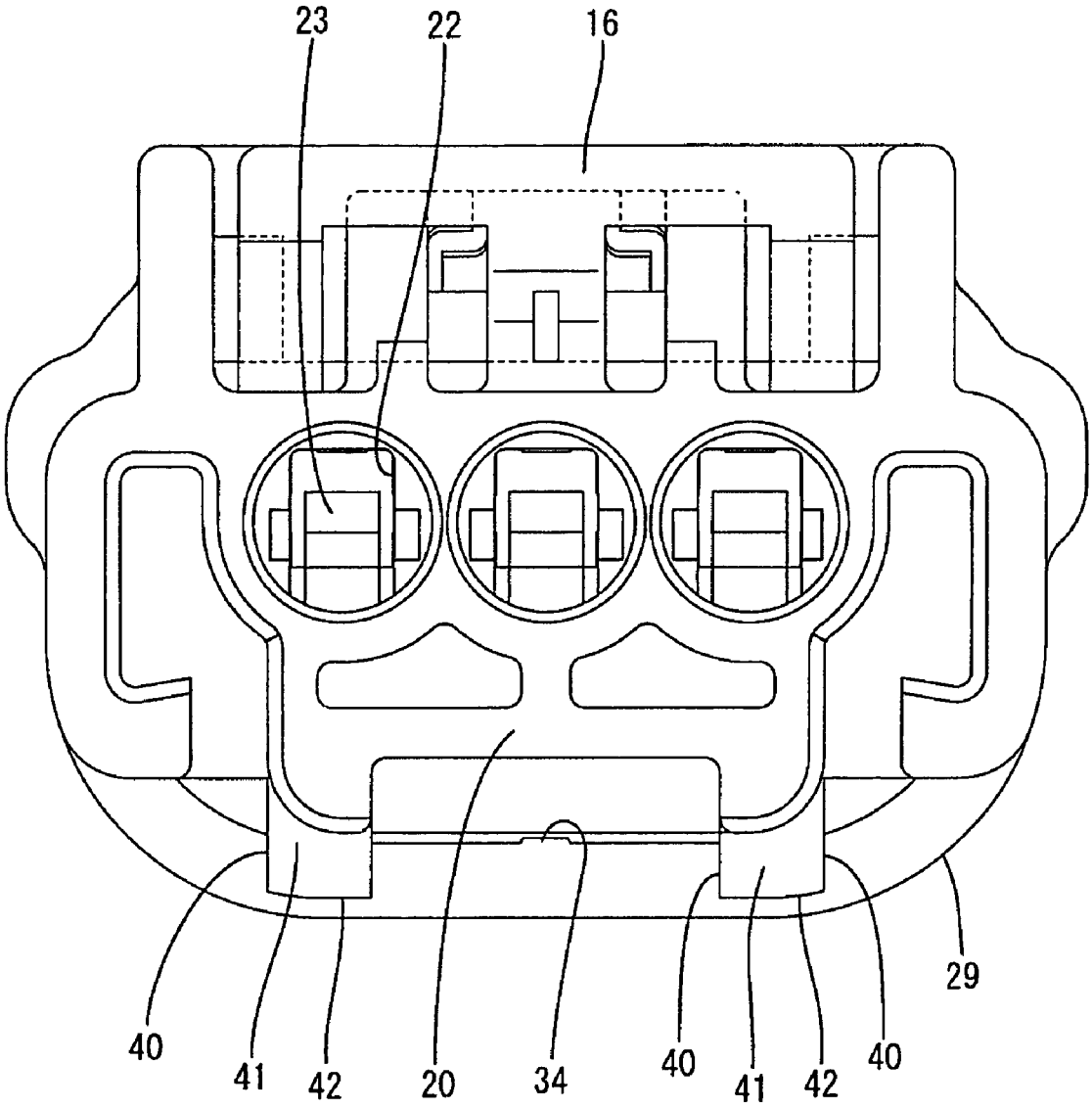
FIG. 16 is a rear view of the female housing.

A second embodiment of the invention is illustrated in FIGS. 13 to 16. The second embodiment has means for reducing a connection resistance when the two housings 10, 20 are connected. However, the other construction is the same as or similar to the first embodiment. Elements with structure, functions and effects that are similar to the first embodiment are identified by the same reference numerals, but are not described again.

The back end 29BE of the bottom wall of the tubular fitting 29 is cut away to form three notches 40 at the opposite lateral sides of the respective preventing projections 32A. The notches 40 penetrate the bottom wall of the tubular fitting 29. The notches 40 extend in forward and backward directions FBD from a position before the front ends of the preventing projections 32A substantially to the rear ends of the preventing projections 32A (i.e. rear end of the tubular fitting 29). The notches 40 form resilient supports 41 on areas of the bottom wall of the tubular fitting 29 where the preventing projections 32A are formed (i.e. areas between each pair of adjacent notches 40). The resilient supports 41 are resiliently deformable in directions intersecting the connecting direction CD of the housings 10, 20. Further, thinned portions 42 are formed in the outer peripheral surface of the rear end of the bottom wall of the tubular fitting 29 by recessing the areas corresponding to the preventing projections 32A and the resilient supports 41. Thus, the resilient supports 41 are thinner than areas before the resilient supports 41.

In this embodiment, the notches 40 are formed at opposite sides of the preventing projection 32A at the back end 29BE of the tubular fitting 29 where the preventing projections 32A are formed and penetrate the bottom wall of the tubular fitting 29. Thus, the resilient supports 41 of the tubular fitting 29 are resiliently displaceable where the preventing projections 32A are provided. The preventing projections 32A contact the receptacle 12 in the process of connecting the two housings 10, 20 and deform resiliently in a direction away from the receptacle 12, thereby reducing a connection resistance resulting from the interference of the preventing projections 32A with the receptacle 12.

Further, the thinned portions 42 are formed in the outer peripheral surface of the tubular fitting 29 by recessing the area between each pair of adjacent notches, i.e. the resilient supports 41 where the preventing projections 32A are formed. Thus, the areas of the tubular fitting 29 that have the preventing projections 32A are thinner and more easily resiliently displaceable. Additionally, the female housing 20 is lighter.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

Although the preventing projections are provided only on the tubular fitting portion in the foregoing embodiments, they may be provided only on the outer circumferential surface of the receptacle or both on the outer circumferential surface of the receptacle and on the inner circumferential surface of the tubular fitting portion according to the present invention.

Although the watertight connectors are described in the foregoing embodiments, the invention is also applicable to non-watertight connectors.

What is claimed is:

1. A connector, comprising:

a first housing accommodating first terminal fittings and having a receptacle surrounding parts of the first terminal fittings, the receptacle having an open front end and a rear end opposite the front end, outer peripheral surface areas extending rearwardly from the front end of the receptacle to the rear end of the receptacle;

a second housing accommodating second terminal fittings, the second housing including a substantially tubular fitting having an open front end, a rear end opposite the front end and an inner peripheral surface extending between the front and rear ends of the tubular fitting, the inner peripheral surface of the tubular fitting being dimensioned for telescoped mounting over the receptacle along a connecting direction, and the first and second terminal fittings being connectable when the tubular fitting is telescoped over the receptacle; and preventing projections on the outer peripheral surface of the receptacle at locations spaced rearwardly from the front end of the receptacle and on the inner peripheral surface of the tubular fitting at locations rearwardly of the front end of the tubular fitting, the preventing projections on the receptacle being in positions to contact the tubular fitting at locations spaced from the preventing projections of the tubular fitting as the first and second housings near complete connection and the preventing projections on the tubular fitting being in positions to contact the outer peripheral surface of the receptacle at locations spaced from the preventing projections on the receptacle as the first and second housing near complete connection for preventing a relative displacement of the receptacle and the tubular fitting in directions transverse to the connecting direction as the first and second housings near complete connection without creating connection resistance at earlier stages of the connection.

2. The connector of claim 1, further comprising a lock arm on a surface of the tubular fitting, and a lock on an outer surface of the receptacle for engaging the lock arm.

3. The connector of claim 1, further comprising guiding ribs on at least one outer surface of the receptacle and extending substantially along a connecting direction of the housings, and guiding grooves in the inner surface of the tubular fitting and extending substantially in the connecting direction of the housings for engaging with the corresponding guiding ribs are.

4. The connector of claim 3, wherein at least one of the preventing projections is provided on at least one of a surface of leading ends of the guiding ribs and surfaces of back ends of the guiding grooves.

5. The connector of claim 1, wherein notches are formed at opposite sides of at least one of the preventing projections of the tubular fitting for weakening a portion of the tubular fitting.

6. The connector of claim 5, further comprising a thin portion recessed in the tubular fitting between the notches.

7. The connector of claim 1, further comprising guiding surfaces at the front ends of the preventing projections and inclined with respect to a connecting direction of the housings.

8. The connector of claim 1, wherein the preventing projections are disposed to prevent relative displacement of the receptacle and the tubular fitting in a first direction transverse to the connecting direction and in a second direction transverse to both the first direction and the connecting direction.

* * * * *